US005556361A

United States Patent [19]

Liao

[11] Patent Number: 5,556,361

[45] Date of Patent: Sep. 17, 1996

[54] FOLDABLE EXERCISE DEVICE CAPABLE OF SIMULATING A HORSE RIDING

[76] Inventor: Nien-Yuan Liao, No. 264, Sec. 2, Shi-Tung Rd., Taichung, Taiwan

[21] Appl. No.: 498,470

[22] Filed: Jul. 5, 1995

[51] Int. Cl.[6] ..... A63B 21/00

[52] U.S. Cl. ..... 482/72; 482/95; 482/96

[58] Field of Search ..... 482/95, 96, 57, 482/72, 98, 106, 110, 120, 123

[56] References Cited

U.S. PATENT DOCUMENTS

| | | | |
|---|---|---|---|
| 3,917,262 | 11/1975 | SalKeld | 482/98 |
| 5,356,357 | 10/1994 | Wang et al. | 482/72 |
| 5,464,378 | 11/1995 | Yu | 482/95 |

*Primary Examiner*—Jerome Donnelly

*Attorney, Agent, or Firm*—Browdy and Neimark

[57] ABSTRACT

A foldable horse-riding exercise device comprises a base having a front support rod and a rear support rod which is provided at the top of the front end thereof with a pivoting portion and at the bottom of the front end thereof with a fastening portion to which the top end of the front support rod is fastened pivotally. Two cross rods are fastened respectively with the free ends of the front and the rear support rods. A support frame is fastened pivotally at the bottom thereof with the pivoting portion of the rear support rod. A pull rod is fastened pivotally at the midsegment thereof with the support frame and is provided with two pedals fastened thereto. A seat rod is fastened pivotally at one end thereof with the base such that the seat rod is linked with the pull rod by a linking member which is fastened pivotally at one end thereof with the pull rod and at another end thereof with the seat rod.

5 Claims, 4 Drawing Sheets

FIG. 1

FOLDABLE EXERCISE DEVICE CAPABLE OF SIMULATING A HORSE RIDING

FIELD OF THE INVENTION

The present invention relates generally to a horse-riding exercise device, and more particularly to a foldable horse-riding exercise device.

BACKGROUND OF THE INVENTION

The conventional horse-riding exercise devices are generally provided with a handle, pedals, a seat, and a linking mechanism for coordinating the motions of various parts of the body of a rider to simulate a horse-riding motion.

Such conventional horse-riding exercise devices as described above are defective in design in that they are rather bulky, and that they can not be kept easily when not in use, and further that they must be completely dismantled to facilitate the transportation thereof.

SUMMARY OF THE INVENTION

It is therefore the primary objective of the present invention to provide an exercise device which is capable of simulating a horse riding and is foldable.

It is another objective of the present invention to provide a horse-riding exercise device which can be folded and unfolded easily.

In keeping with the principle of the present invention, the foregoing objectives of the present invention are attained by a foldable horse-riding exercise device, which comprises a base having a front support rod and a rear support rod which is provided at the top of the front end thereof with a pivoting portion and at the bottom of the front end thereof with a fastening portion to which the top end of the front support rod is fastened pivotally. Two cross rods are fastened respectively with the free ends of the front and the rear support rods. A support frame is fastened pivotally at the bottom thereof with the pivoting portion of the rear support rod. A pull rod is fastened pivotally at the midsegment thereof with the support frame and is provided with two pedals fastened thereto. A seat rod is fastened pivotally at one end thereof with the base such that the seat rod is linked with the pull rod by a linking member which is fastened pivotally at one end thereof with the pull rod and at another end thereof with the seat rod.

The foregoing objectives, features and functions of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
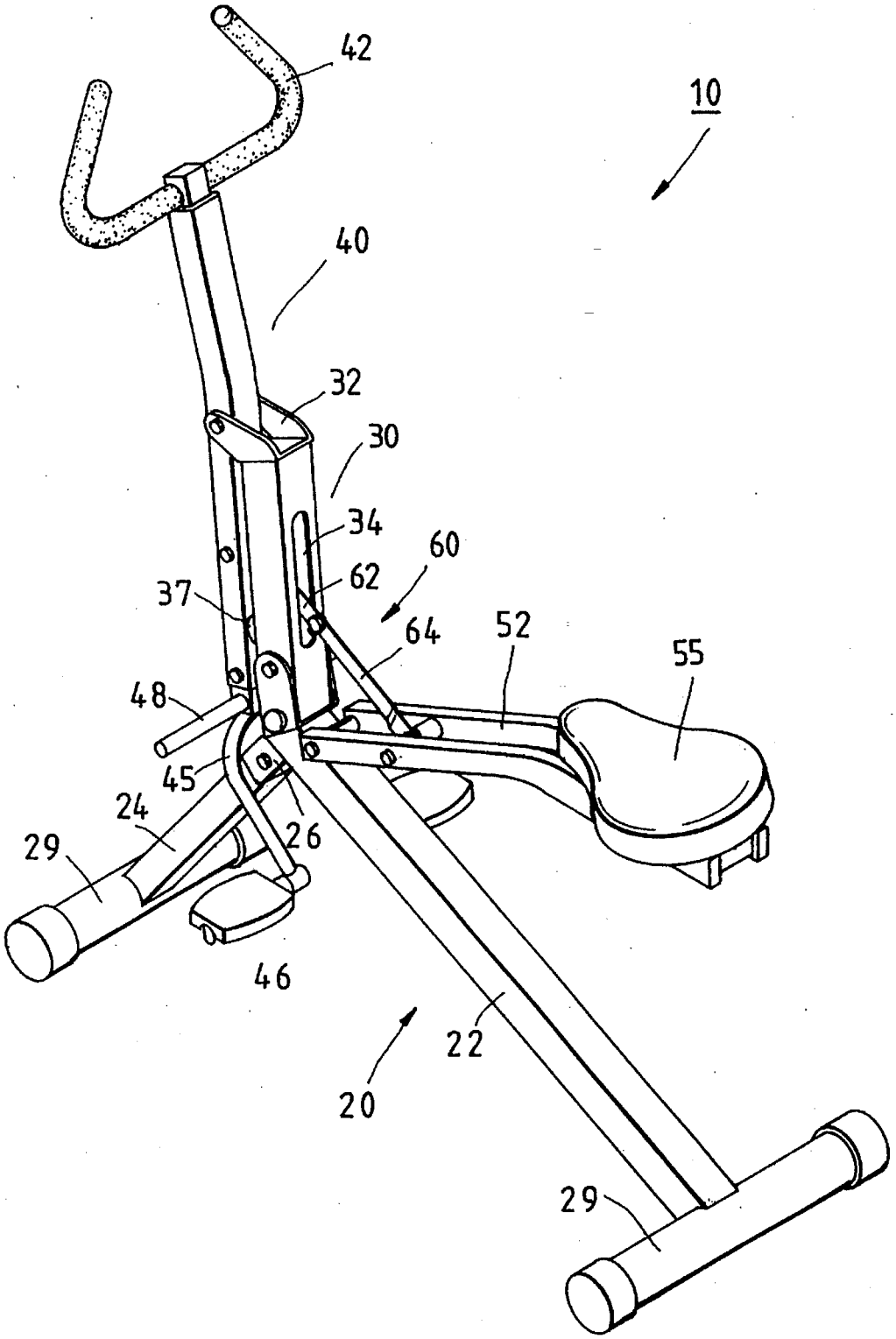
FIG. 1 shows a perspective view of the preferred embodiment of the present invention.
Figure 2:
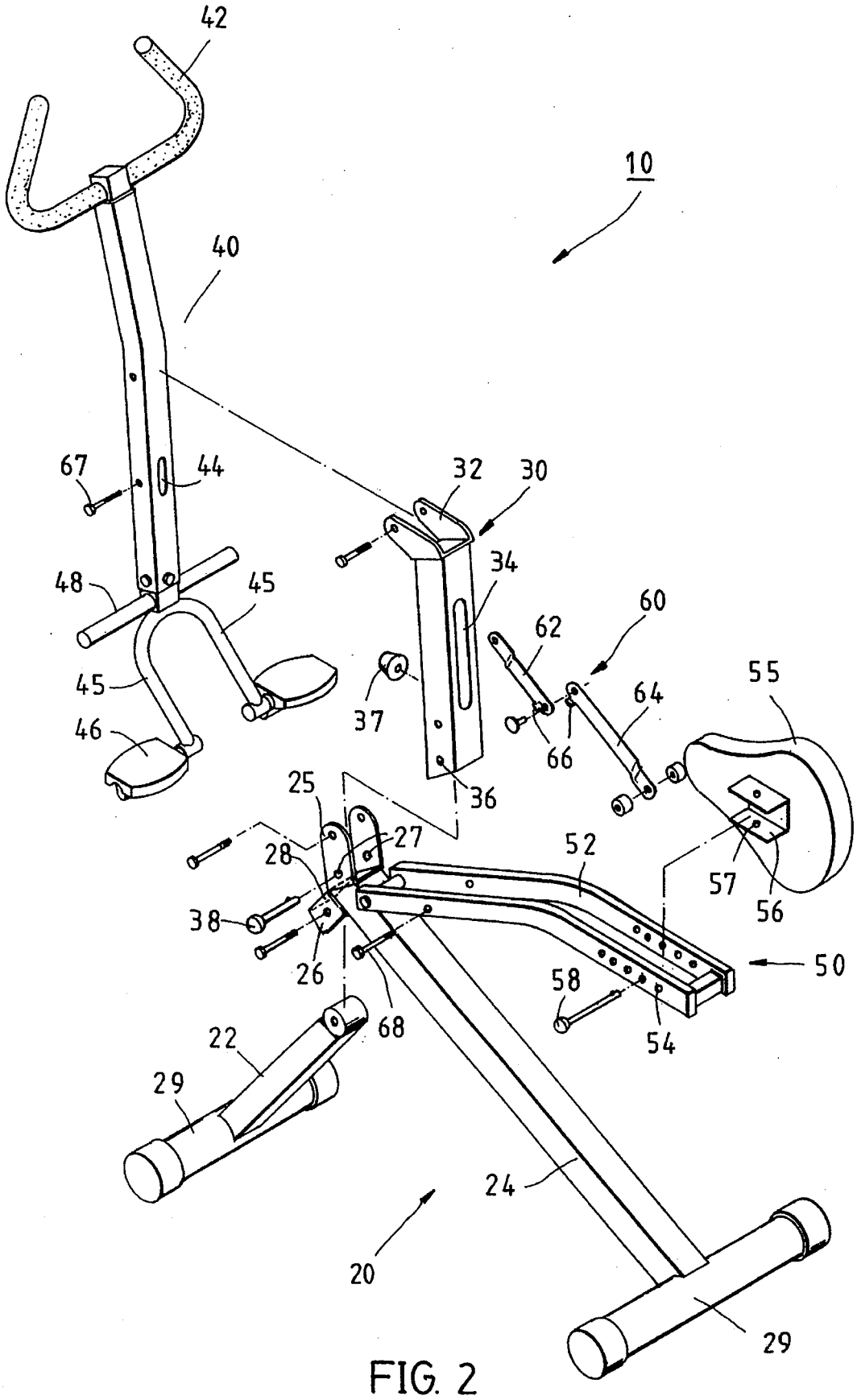
FIG. 2 shows an exploded view of the preferred embodiment as shown in FIG. 1.
Figure 3:
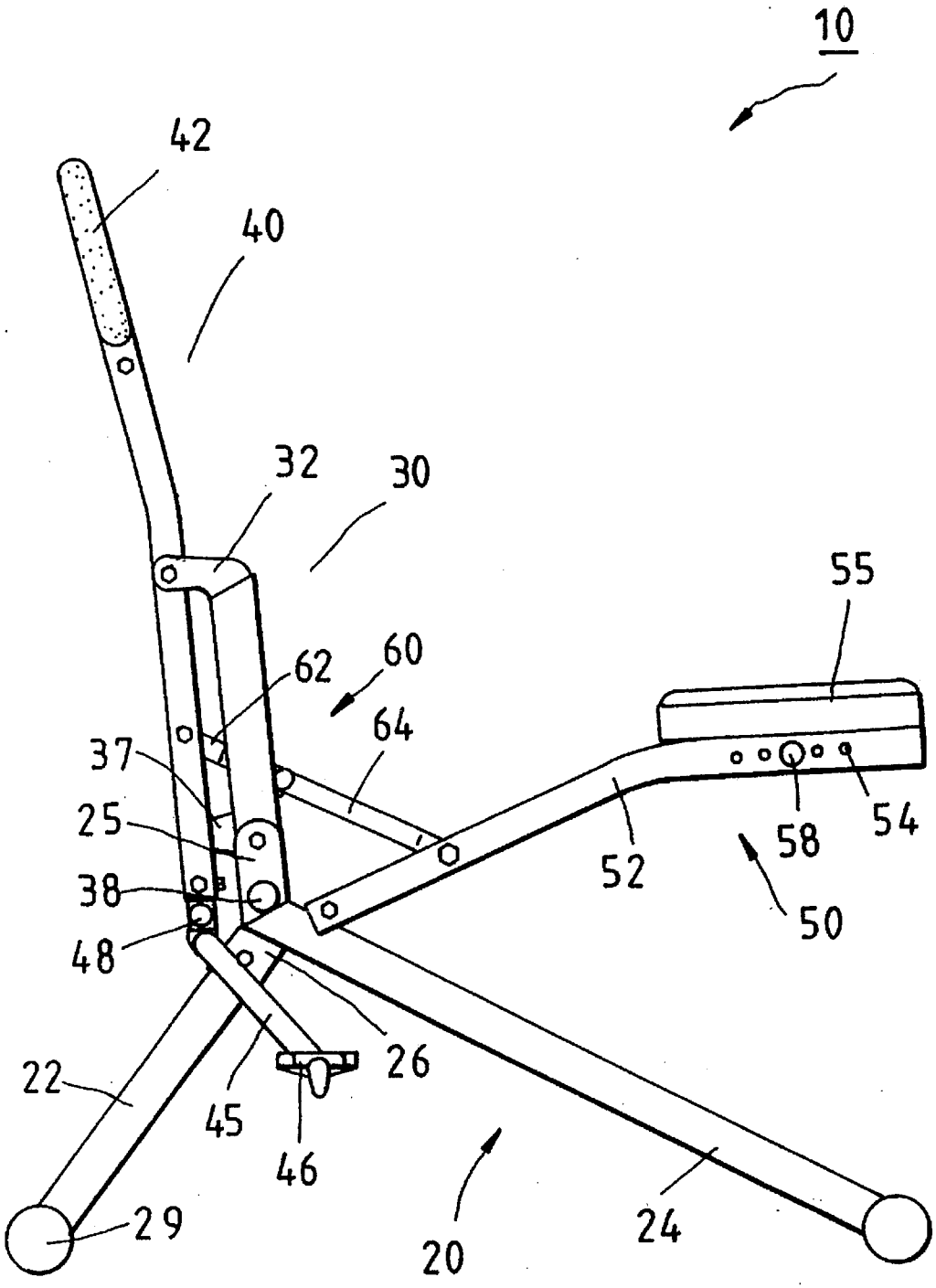
FIG. 3 shows a side elevational view of the present invention which is unfolded.

As shown in FIGS. 1 and 2, a foldable horse-riding exercise device 10 of the preferred embodiment of the present invention comprises the component parts which are described explicitly hereinafter.

A base 20 comprises a front support rod 22 and a rear support rod 24 which is provided on the top of the front end thereof with a pivoting portion 25 having two lugs. The rear support rod 24 is further provided at the bottom of the front end thereof with a fastening portion 26 having a U-shaped cross section. The pivoting portion 26 is provided with a fastening hole 27. The front support rod 24 is fastened pivotally at the top thereof with the fastening portion 26 such that the front support rod 22 is located by the locating portion 28 of the fastening portion 26 when the front support rod 22 iS caused to swing outwards. Two cross rods 29 are fastened respectively with the free ends of the front and the rear support rods 22 and 24 so as to stabilize the base 20. A support frame 30 is provided at the top thereof with two pivoting portions 32 and is further provided therein with an empty space 34 or elongated aperture. The support frame 30 is still further provided at the bottom walls thereof with the fastening holes 36 and in the front side thereof with a cushioning member 37. The support frame 30 is fastened pivotally at the bottom thereof with the pivoting portion 25 of the rear support rod 24 such that the fastening holes 36 of the support frame 30 are corresponding in location to the fastening hole 27 of the pivoting portion 25 of the rear support rod 24. A fastening member 38 is engaged with the fastening holes 36 and 27 for locating the support frame 30 and the rear support rod 24.

A pull rod 40 is provided at the top end thereof with a handle 42 fastened thereto and is further provided in the rear side surface of the midsegment thereof with a slotted portion 44. The pull rod 40 is provided at the bottom end thereof with two pedal rods 45 fastened thereto. Two pedal rods 45 are provided respectively with a pedal 46 fastened pivotally thereto. The pull rod 40 is provided at the bottom end thereof with a gripping member 48 fastened horizontally thereto. The pull rod 40 is fastened pivotally with the pivoting portion 32 of the support frame 30 such that the slotted portion 44 of the pull rod 40 is located under the pivoting portion 32.

A seat rod 50 comprises two rod bodies 52 parallel to each other and fastened pivotally with the rear support rod 24 of the base 20. The rod bodies 52 are provided respectively at the free end thereof with a plurality of through holes 54 spaced equidistantly. A seat pad 55 is provided on the underside thereof with two winged portions 56 which are provided respectively with a through hole 57. The seat pad 55 is fastened with the free ends of the rod bodies 52 such that the winged portions 56 are located between two rod bodies 52, and that the seat pad 55 is secured by a fastening pin 58 engageable with the through holes 54 of the rod bodies 52 and the through holes 57 of the winged portions 56. The seat pad 55 is adjustably fastened with the rod bodies 52.

A linking member 60 comprises two link rods 62 and 64, which are provided respectively at one end thereof with a fastening portion 66 and are fastened pivotally by a pin engageable with the fastening portions 66. The linking member 60 is fastened pivotally by a pivot 67 with the slotted portion 44 of the pull rod 40 such that one end of the linking member 60 is put through the empty space 34 of the support frame 30, and that another end of the linking member 60 is fastened pivotally with the midsegment of the seat rod 50 by a pivot 68.

In operation, the front support rod 22 is first swiveled outwards such that the front support rod 22 is located at the locating portion 28 of the fastening portion 26 so as to cause the front and the rear support rods 22 and 24 of the base 20 to rest securely on the ground. The support frame 30 and the pull rod 40 are then set uprightly. While the pull rod 40 is in the process of being set uprightly, the linking member 60 is so actuated that two link rods 62 and 64 of the linking member 60 are caused to become straight. Subsequently, the seat rod 50 is actuated to swing upwardly so as to unfold the exercise device 10 completely. The support frame 30 is located securely on the base 20 by means of the pin 38 engageable with the fastening holes 27 and 36.

The user of the device 10 of the present invention is seated on the seat pad 55, with his or her hands holding the handle 42 and with his or her feet treading on the pedals 46. The bottom end of the pull rod 40 can be caused to swivel forward when two pedals 46 are pedaled and when the pull rod 40 is pulled backwards, thereby actuating the linking member 60 as well as the seat rod 50. As a result, the seat pad 55 is moved upwards. As soon as the pull rod 40 and the pedals 46 are relieved of the pressure exerting thereon, the seat pad 55 can be caused to move downwards by virtue of the weight of the user sitting thereon. The pull rod 40 is then actuated by the linking member 60 to return to its initial position. The user of the device 10 of the present invention is therefore capable of doing a horse-riding exercise by repeating the motions described above.

Figure 4:
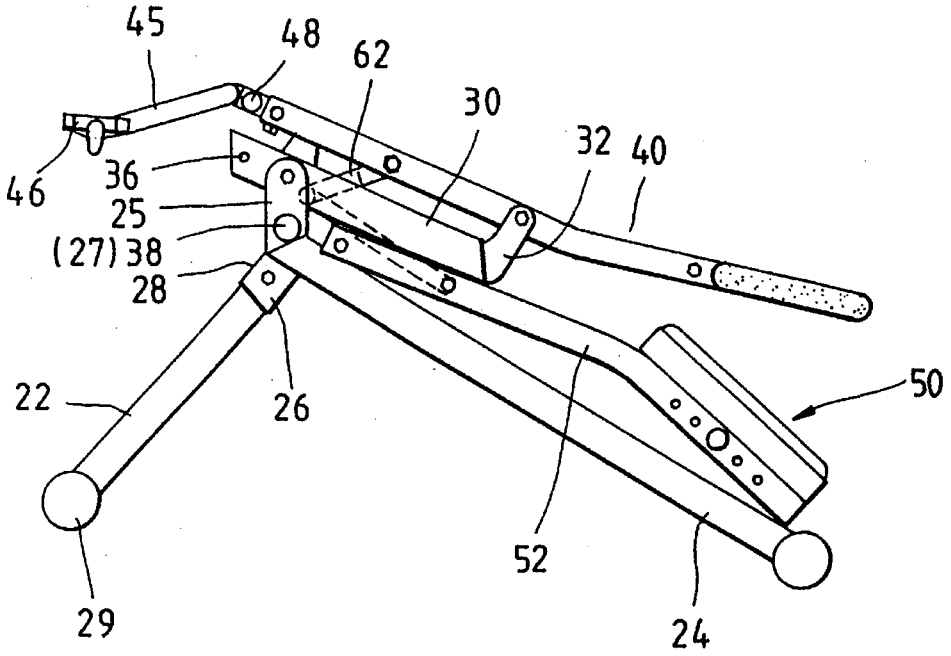
FIG. 4 shows a schematic view of a partially folded device of the present invention.
Figure 5:
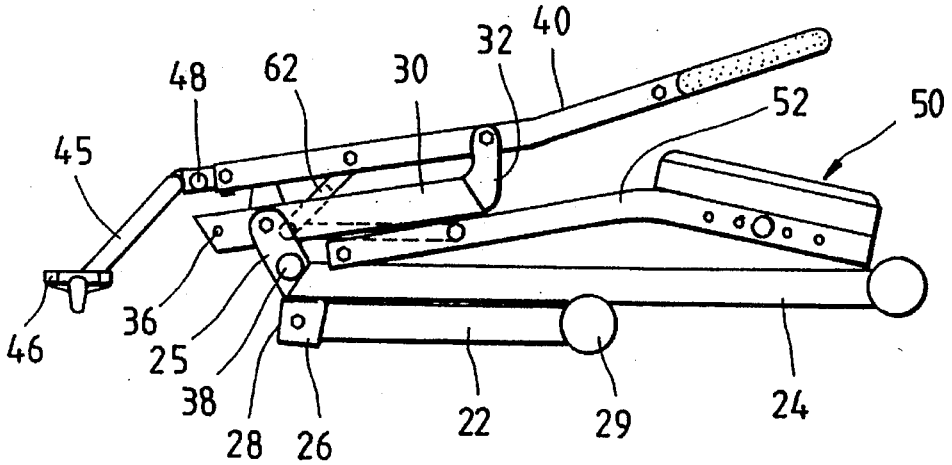
FIG. 5 shows a schematic view of a completely folded device of the present invention.

The device 10 of the present invention can be folded by removing the pin 38 so as to allow the support frame 30 to be swiveled. The pull rod 40 and the support frame 30 can be then folded backwards. In the meantime, the linking member 60 and the seat rod 50 are folded backwards until the seat rod 50 is rested on the rear support rod 24. Two link rods 62 and 64 of the linking member 60 are folded and received in the empty space 34 of the support frame 30, as shown in FIG. 4. The front end of the base 20 is lifted with one hand before the front support rod 22 is swiveled inwards so as to join with the rear support rod 24. The device 10 of the present invention is then folded completely, as shown in FIG. 5.

The folded device 10 of the present invention can be unfolded by causing the front support rod 22 to swivel outwards to rest against the fastening portion 26. Thereafter, the pull rod 40, the support frame 30, the linking member 60, and the seat rod 50 are spread out. The base 20 and the support frame 30 are located securely by the pin 38 which is inserted into the fastening holes 27 and 36.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A foldable horse-riding exercise device comprising:

a base comprising a front support rod, a rear support rod, two cross rods, and a support frame, said front support rod being fastened at a top end thereof with a front end of said rear support rod such that said front support rod and said rear support rod form a predetermined angle, said two cross rods being fastened respectively and horizontally with bottom free ends of said front support rod and said rear support rod, said support frame provided with an elongated aperture and fastened at a bottom thereof with said base;

a pull rod fastened pivotally at a midsegment thereof with said support frame and including two pedals fastened thereto;

a seat rod fastened pivotally at one end thereof with said top and of said front support rod (22) and provided at another end thereof with a seat pad; and a linking member disposed in said elongated aperture of said support frame such that said linking member is fastened pivotally at one end thereof with said pull rod, and that said linking member is fastened pivotally at another end thereof with said seat rod;

said rear support rod including on a top of a front end thereof a pivoting portion having a fastening means, said rear support rod further including on an underside of said front end thereof a first fastening portion having on a front end thereof a locating portion;

said front support rod being fastened pivotally at a top end thereof with said fastening portion of said rear support rod such that said front support rod can be so swiveled as to be located by said locating portion of said rear support rod;

said support frame including at a bottom thereof a fastening portion and being fastened pivotally with said pivoting portion of said rear support rod such that said fastening portion of said support frame is corresponding in location to said fastening portion of said pivoting portion of said rear support frame;

said linking member comprising two link rods which are fastened end to end pivotally and are further fastened respectively at a free end thereof with said pull rod and said seat rod.

2. The exercise device as defined in claim 1, wherein said fastening portion of said rear support rod includes a U-shaped cross section and two side walls for fastening thereto said front support rod, with one of said two side walls having a locating portion.

3. The exercise device as defined in claim 1, including a gripping means fastened to said pull rod is provided at a bottom end thereof.

4. The exercise device as defined in claim 1, including a second fastening portion of said two link rods of said linking member.

5. The exercise device as defined in claim 1, wherein said first fastening portion of said pivoting portion includes a through hole engageable with a fastening pin; and wherein said first fastening portion of said support frame includes a through hole engageable with said fastening pin.

* * * * *

UNITED STATES PATENT AND TRADEMARK OFFICE

CERTIFICATE OF CORRECTION

PATENT NO. : 5,556,361 Page 1 of 2

DATED : September 17, 1996

INVENTOR(S) : LIAO, Nien-Yuan

It is certified that error appears in the above-indentified patent and that said Letters Patent is hereby corrected as shown below:

On the title page and sheet 1 of the drawings, please delete original Figure 1 and insert therefor the following corrected Figure 1:

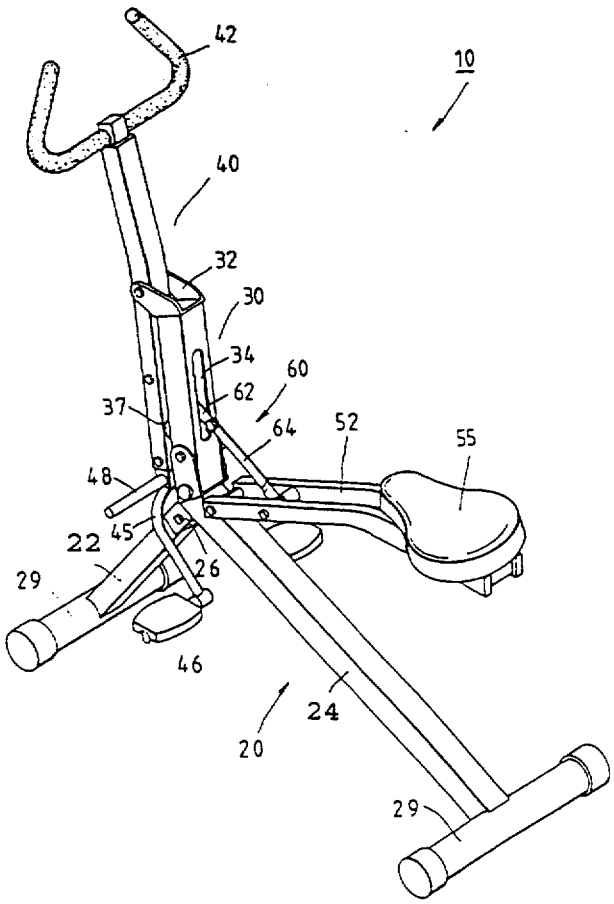

FIG. 1

UNITED STATES PATENT AND TRADEMARK OFFICE

CERTIFICATE OF CORRECTION

PATENT NO. : 5,556,361

DATED : September 17, 1996

INVENTOR(S) : LIAO, Nien-Yuan

It is certified that error appears in the above-indentified patent and that said Letters Patent is hereby corrected as shown below:

Claim 1, column 4, line 13, change "and" to --end--, change "front" to --rear-- and delete "(22)";
column 1, line 21, change "means" to --portion--.
Claim 3, column 4, line 46, delete "is";
column 4, line 47, change "bottom" to --top--.

Signed and Sealed this

Twenty-fifth Day of February, 1997

*Attest:*

*Attesting Officer*

BRUCE LEHMAN

*Commissioner of Patents and Trademarks*